US006557203B2

(12) United States Patent
Meshbesher

(10) Patent No.: US 6,557,203 B2
(45) Date of Patent: May 6, 2003

(54) FOOTWEAR CLEANING AND SANITIZING DEVICE

(76) Inventor: Irwin B Meshbesher, P.O. Box 007, Rte. 1, Chaseburg, WI (US) 54621

( * ) Notice: Subject to any disclaimer, the term of this patent is extended or adjusted under 35 U.S.C. 154(b) by 0 days.

(21) Appl. No.: 09/866,306

(22) Filed: May 25, 2001

(65) Prior Publication Data

US 2002/0174499 A1 Nov. 28, 2002

(51) Int. Cl.[7] ..... A47L 23/22
(52) U.S. Cl. ..... 15/104.92; 15/112; 15/161
(58) Field of Search ..... 15/112, 104.92, 15/161

(56) References Cited

U.S. PATENT DOCUMENTS

| | | | | | |
|---|---|---|---|---|---|
| 173,707 | A | * | 2/1876 | Worley | 15/112 |
| 516,541 | A | * | 3/1894 | Knoepfel | 15/112 |
| 1,117,883 | A | * | 11/1914 | Minkler | 15/112 |
| 2,261,231 | A | * | 11/1941 | Cottingham | 15/112 |
| 2,436,234 | A | * | 2/1948 | Stein | 15/161 |
| D297,785 | S | | 9/1988 | Meshbesher | D4/119 |
| 4,866,805 | A | * | 9/1989 | Oden et al. | 15/104.92 |
| D439,714 | S | | 3/2001 | Meshbesher | D32/47 |

FOREIGN PATENT DOCUMENTS

| | | | | |
|---|---|---|---|---|
| FR | 2567013 | * | 1/1986 | 15/161 |
| FR | 2631532 | * | 11/1989 | 15/104.92 |
| GB | 1246620 | * | 9/1971 | 15/112 |

* cited by examiner

*Primary Examiner*—Mark Spisich
(74) *Attorney, Agent, or Firm*—Ryan Kromholz & Manion, S.C.

(57) ABSTRACT

Apparatus for cleaning and sanitizing footwear includes a container for disinfectant liquids which container has an upwardly open U-shaped channel tack-welded to the bottom panel of the container in which channel at least one brush is removably attached. The brush is adapted to remove debris from the bottom of footwear while a pair of inwardly facing brushes are provided for cleaning the sides of the footwear. Preferably, a scraper blade is attached to one end panel of the container. Outwardly extending flanges are provided on opposed surfaces of the container for manual grasping and lifting of the device. Optionally, a pair of laterally extending L-shaped brackets is attached opposite sides of the container are provided for to stabilizing the device during use.

7 Claims, 2 Drawing Sheets

FOOTWEAR CLEANING AND SANITIZING DEVICE

BACKGROUND OF THE INVENTION

This invention relates to apparatus for cleaning and sanitizing footwear. More particularly, the invention relates to a device which enables scraping debris from the sole of a boot or shoe and brushing the sides and sole thereof while also bathing the footwear with sanitizing fluid.

Various footwear scraping devices have heretofore been provided for use by workmen, sportsmen such as golfers, and the general public in locations where accumulations of mud, grass or other debris need to be periodically removed from the footwear, for example, prior to entry into a building. Recently, outbreaks of communicable diseases particularly among livestock have reached epidemic proportions in many locations worldwide. Thus, a heightened concern has risen for developing ways to minimize transmission of such diseases.

Among the concerns are cleaning and sanitization of clothing and particularly footwear worn by persons who may travel in and out of infected areas. Various options include brushing, scraping, pressure washing etc. of the footwear. All of the available cleaning methods, however, have involved obvious disadvantages. A need has thus existed for an improved device for cleaning and sanitizing footwear.

SUMMARY OF THE INVENTION

It is a principal object of the present invention to provide a device which is simple and convenient to use and which combines the functions of removal of debris from the exterior of footwear with sanitization of the footwear. A related aspect of the invention involves the provision of a device which affords the ability to fully scrape debris from the bottom of footwear and to subsequently brush both the bottom and sides of the footwear to accomplish further cleaning thereof all in a single device. A further related aspect pertains to the provision of a container in conjunction with other components of the device which provides a reservoir for a suitable disinfectant or biocidal solution thereby facilitating washing and removal of living microorganisms from the exterior of the footwear.

A further object of the invention relates to provision of such a device which can readily be carried for emptying of the reservoir as it becomes filled with debris and spent sanitizing liquid so that it can be emptied and cleaned and subsequently refilled with a new batch of liquid. A still further aspect of the of the invention relates to provision of laterally extending brackets which are situated in a plane co-extensive with bottom of the reservoir so that the user can stand on a bracket with one foot to stabilize the device while cleaning the other foot. A still further aspect of the invention relates to provision of such a laterally extending bracket on each side of the device so that each foot can be cleaned, in turn, while the device remains stabilized.

Briefly, the invention provides apparatus for cleaning and sanitizing footwear which includes a container for disinfectant liquids and which has an upwardly open U-shaped channel tack-welded to the bottom panel of the container in which channel at least one brush is removably attached. The brush is adapted to remove debris from the bottom of footwear while a pair of inwardly facing brushes are provided for cleaning the sides of the footwear. Preferably, a scraper blade is attached to one end panel of the container.

Outwardly extending flanges are provided on opposed surfaces of the container for manual grasping and lifting of the device. Optionally, a pair of laterally extending L-shaped brackets is attached opposite sides of the container are provided for to stabilizing the device during use.

Further objects and advantages of the invention will be apparent from the appended claims and accompanying drawings and fully set forth in the following detailed description.

DETAILED DESCRIPTION OF THE INVENTION

Figure 1:
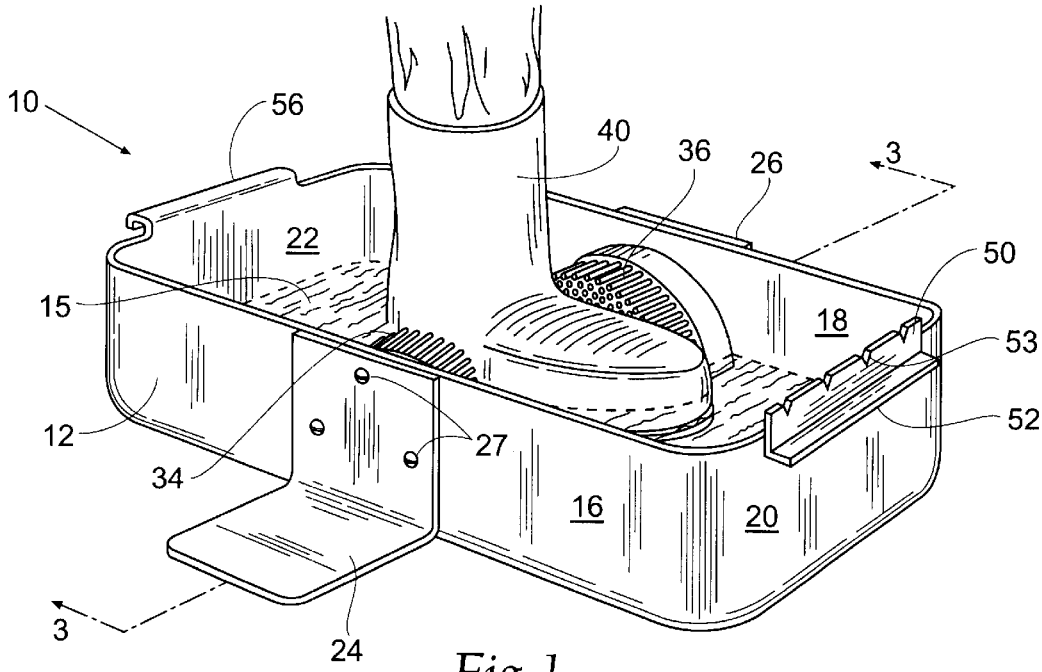
FIG. 1 is a perspective view of the device in conjunction with a boot being cleaned.
Figure 3:
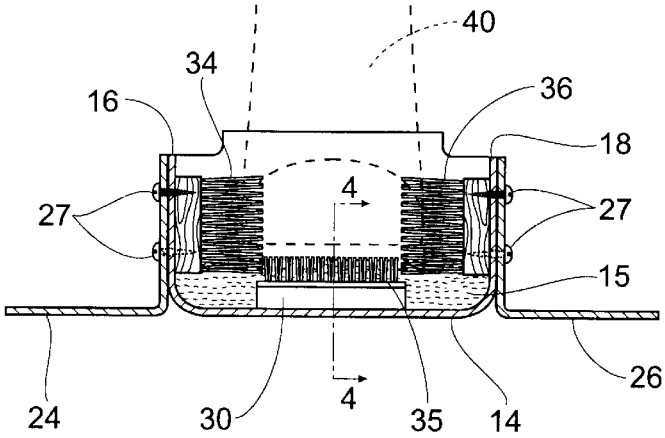
FIG. 3 is a sectional view taken along Line 3—3 of FIG. 1.
Figure 4:
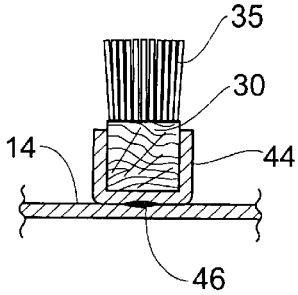
FIG. 4 is a fragmentary sectional view taken along Line 4—4 of FIG. 3; and, FIG. 5 is a bottom plan view of the device of FIG. 2
Figure 2:
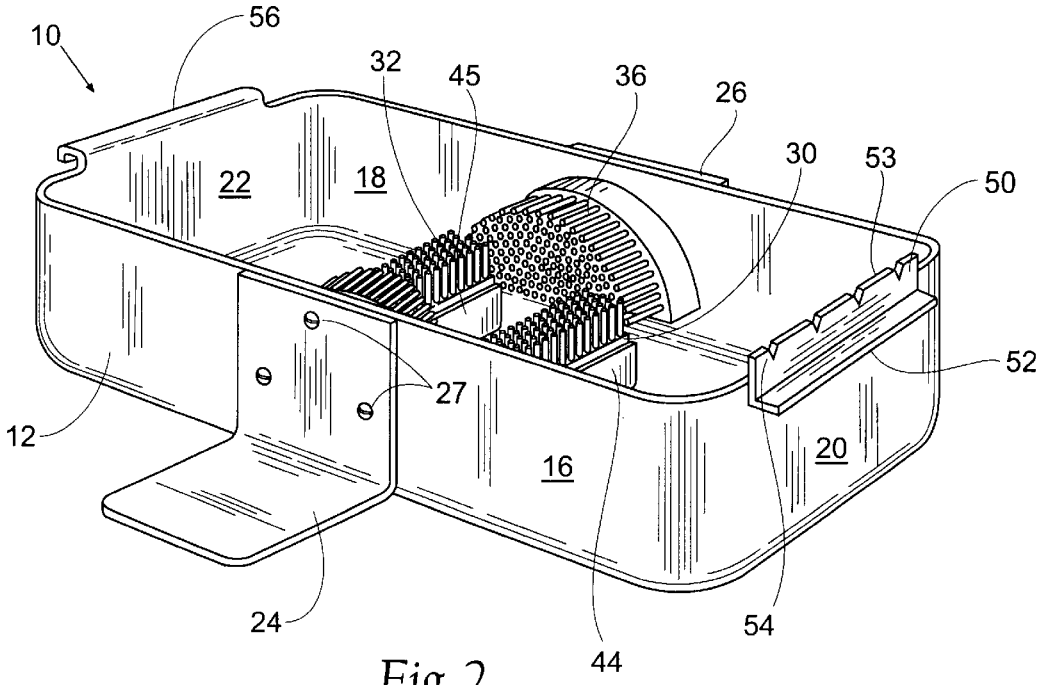
FIG. 2 is another perspective view of the device of FIG. 1.
Figure 5:
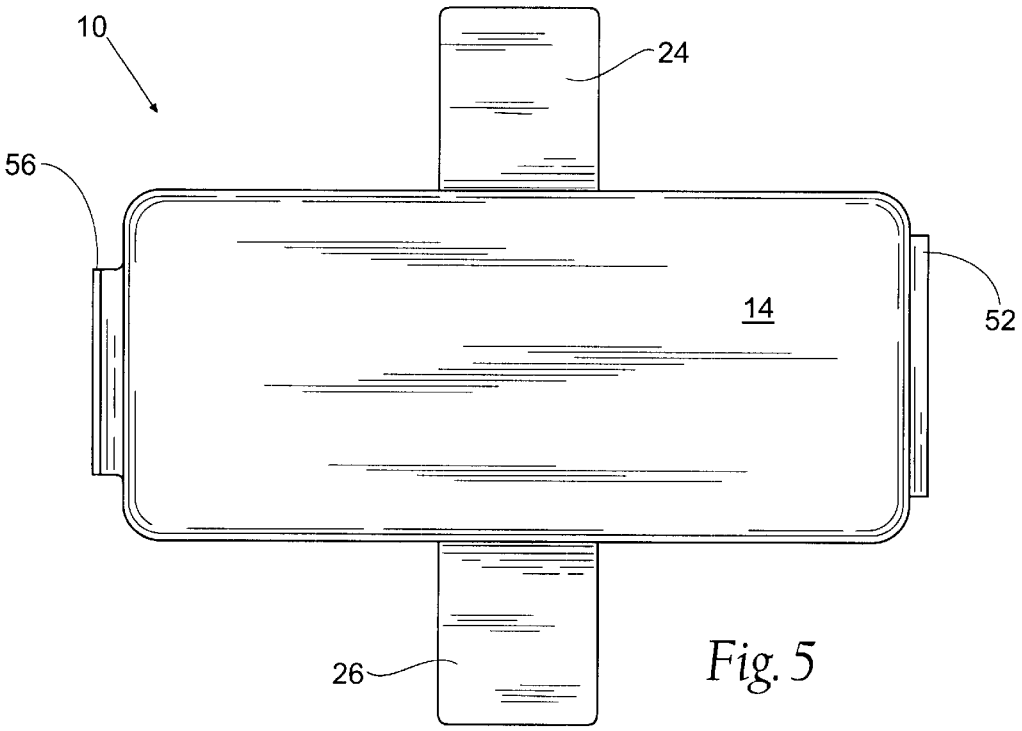

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring more particularly to the drawings, a device of this invention is indicated generally by numeral 10 and includes a container 12 preferably in the form of a shallow pan adapted to contain a disinfectant fluid 15. Container 12 is defined by a bottom panel 14 and upstanding opposed side panels 16 and 18, which are seamlessly interconnected with upstanding end panels 20 and 22 as well as the bottom panel 14. Attached to the sidewalls 16 and 18 are stabilizer brackets 24 and 26, respectively. These brackets are preferably mounted by means of mechanical fasteners 27 which can be spot welds, bolts, rivets or the like. The preferred embodiment of utilizes wood screws for fasteners 27.

Attached to the bottom panel 14 are brushes 30 and 32. Brushes 30 and 32 preferably include wooden or plastic blocks out of which bristles 35 project. The preferred mode of attachment of the blocks 30 and 32 to the bottom panel 14 is by the attachment thereto of U-shaped channels 44 and 45 by means of spot welds 46 which enable the formation of a container 12 with a leakproof bottom panel 14. Channels 44 and 45 are adapted to receive the blocks 30 and 32 sufficiently tightly to hold them in place during use. A pair of side brushes 34 and 36 also formed by bristles 35 secured in conventional fashion into wooden blocks which are mounted to the side walls 16 and 18, respectively. Bolts or wood screws 27 can be used for that purpose and may be of a length sufficient to mount both the brushes 34 and 36 as well as the brackets 24 and 26 to the side walls 16 and 18, respectively.

In use, the wearer will insert boots 40 one at a time into the device after scraping the same on scraper bar 53. Scraper bar 53 is preferably formed by an L-shaped member 50 which also includes a laterally extending flange 52. Device 10 can be readily lifted and carried by grasping the flange 52 and another flange 56 at the opposite end of container 12.

It will thus be apparent that the user can first scrape the heel and sole of the boot 40 along the upper edge of scraper blade 54 preferably in a manner so that the debris falls outside of the container 12. The scraped boot is then inserted into the space defined by the brushes 30, 32, 34 and 36. A brushing action forward and backward then cleans the side surfaces of the footwear 40 along with further cleaning of the heel and sole thereof. The biocidal liquid 15 is contained to a level so that the bottom of the footwear 40 will be washed and sanitized thereby.

It will be appreciated that after a number of cleanings debris will have accumulated in the biocidal liquid 15 to the extent that its effectiveness may decrease. The liquid can then be disposed of for example by burial of pouring into a proper treatment system and replaced with a fresh supply.

Various disinfectant liquids can be used as the biocidal liquid 15. Such liquids are commercially available and the exact composition thereof does not form a part of this invention.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. Apparatus for cleaning and sanitizing footwear comprising a container for disinfectant liquids having a bottom panel and integrally attached side and end panels, means for brush attachment affixed to said bottom panel, said means for attachment comprise an upwardly open U-shaped channel, a brush removably attached to said attachment means, said brush being adapted to remove debris from the bottom of footwear, first and second brushes each attached to a respective one of said side panels, said first and second brushes being adapted to clean the sides of the footwear, and an upwardly extending scraper blade affixed to said container and adapted for scraping of debris off of the bottom of the footwear.

2. Apparatus according to claim 1 wherein said scraper blade is attached to and extends upwardly from one of said end panels.

3. Apparatus according to claim 2 wherein said scraper blade is integral with a flange adapted to be manually grasped for lifting of said apparatus.

4. Apparatus according to claim 1 wherein flanges extend outwardly from opposed surfaces of said container, said flanges being adapted to be grasped manually whereby said apparatus can be lifted and transported.

5. Apparatus according to claim 1 wherein an L-shaped bracket is attached to each of said side panels, each of said brackets extending laterally from opposite sides of said container, said brackets being adapted to stabilize said apparatus during use.

6. Apparatus according to claim 1 wherein said U-shaped channel is affixed to said bottom panel of said container by means of spot welds.

7. A movable apparatus for cleaning and sanitizing footwear comprising:

a container for holding liquids having a bottom panel and integrally attached side and end panels, at least one bottom brush adapted to remove debris from the bottom of footwear, bottom brush attachment means affixed to said bottom panel, said at least one bottom brush being removably attached to said bottom panel by said bottom brush attachment means, first and second side brushes, each of said side brushes attached to a respective side panel, an upwardly extending scraper blade affixed to said container, at least one L-shaped bracket attached to one of said side panels, said L-shaped bracket allowing a person to manually secure the apparatus in place with said person's foot, and flanges extend outwardly from opposed surfaces of said container, said flanges forming handles to be grasped manually whereby said apparatus can be lifted and transported.

* * * * *